US005324605A

United States Patent [19]

Ono et al.

[11] Patent Number: 5,324,605

[45] Date of Patent: Jun. 28, 1994

[54] ELECTROPHOTOGRAPHIC PLATE WITH AN ARYLAMINE-CONTAINING PHOTOSENSITIVE LAYER

[75] Inventors: Hitoshi Ono, Yokohama; Atsuo Saita, Machida, both of Japan

[73] Assignee: Mitsubishi Kasei Corporation, Tokyo, Japan

[21] Appl. No.: 920,169

[22] Filed: Jul. 27, 1992

Related U.S. Application Data

[63] Continuation of Ser. No. 634,718, Dec. 27, 1990, abandoned.

[30] Foreign Application Priority Data

Dec. 29, 1989 [JP] Japan ..... 1-343215

[51] Int. Cl.[5] ..... G03G 5/06

[52] U.S. Cl. ..... 430/59; 430/56; 430/73; 430/75; 430/76

[58] Field of Search ..... 430/59, 73, 75, 76, 430/56

[56] References Cited

U.S. PATENT DOCUMENTS 3,387,973 7/1968 Fox et al. .
4,485,160 11/1984 Suzuki .
4,931,350 6/1990 Shimada et al. ..... 430/73

FOREIGN PATENT DOCUMENTS 210775 2/1987 European Pat. Off. .
57-125941 8/1982 Japan ..... 430/59
57-210343 12/1982 Japan ..... 430/59

OTHER PUBLICATIONS

"Thiophenyl", Hackh's Chemical Dictionary, J. Grant, p. 677 (1972).

*Primary Examiner*—Christopher Rodee
*Attorney, Agent, or Firm*—Oblon, Spivak, McClelland, Maier & Neustadt

[57] ABSTRACT

An electrophotographic photoreceptor comprising an electrically conductive support and a photosensitive layer formed thereon, wherein said photosensitive layer contains an arylamine compound of the formula (I):

(I)

wherein each of $Ar^1$, $Ar^2$, $Ar^3$ and $Ar^4$ which may be the same or different, is an aryl group which may have substituents, or a heterocyclic group which may have substituents, each of $R^1$, $R^2$, $R^3$, $R^4$, $R^5$ and $R^6$ which may be the same or different, is a hydrogen atom, a hydroxyl group, a halogen atom, an alkyl group which may have substituents, an alkoxy group which may have substituents, or a phenyl group which may have substituents, and each of $R^7$ and $R^8$ which may be the same or different, is a hydrogen atom, a halogen atom, an alkyl group which may have substituents, or an alkoxy group which may have substituents.

15 Claims, 1 Drawing Sheet

ELECTROPHOTOGRAPHIC PLATE WITH AN ARYLAMINE-CONTAINING PHOTOSENSITIVE LAYER

This application is a continuation of application Ser. No. 07/634,718, filed on Dec. 27, 1990, now abandoned.

This invention relates to an electrophotographic photoreceptor. More particularly, it relates to a highly sensitive electrophotographic photoreceptor having a photosensitive layer comprising an organic photoconductive material.

BACKGROUND OF THE INVENTION

Heretofore, inorganic photoconductive materials such as selenium, cadmium sulfide and zinc oxide have been widely used in the photosensitive layers of the electrophotographic photoreceptors. However, selenium and cadmium sulfide are required to be recovered as toxic substances. Further, selenium is crystallized by heat and thus is inferior in the heat resistance. Cadmium sulfide and zinc oxide are inferior in the moisture resistance. Zinc oxide has a drawback that it is poor in the printing resistance. Under these circumstances, research efforts are still being made to develop novel photosensitive materials. Recently, studies on use of organic photoconductive materials for the photosensitive layers of the electrophotographic photoreceptors have been advanced, and some of them have materialized into practical use. The organic photoconductive materials have many advantages over the inorganic materials. For example, they are light in weight and easy to fabricate into films, and they can be easily manufactured into photoreceptors or into transparent photoreceptors depending upon the type of the material.

Recently, the main research activities are directed to so-called function-separated photoreceptors whereby functions of generating and transporting electric charge carriers are performed by separate compounds, since they are effective for high sensitivity, and organic photoreceptors of this type have been practically employed.

As a carrier transporting material, a polymer photoconductive compound such as polyvinyl carbazole may be employed. Otherwise, a low molecular weight photoconductive compound may be used as dispersed or dissolved in a binder polymer.

Particularly in the case of an organic low molecular weight photoconductive compound, it is possible to select as a binder a polymer excellent in the film-forming property, flexibility and adhesive property, whereby a photoreceptor excellent in the mechanical property can readily be obtained. For this purpose, not only hydrazone compounds and stilbene compounds but also triarylamine compounds have been studied (U.S. Pat. Nos. 3,180,730, 3,387,973, 4,123,269 and 4,127,412). However, it has been difficult to find a suitable compound for the preparation of a highly sensitive photoreceptor.

Especially, color copying machines have been developed in recent years, and photoreceptors suitable for such copying machines are desired. However, conventional photoreceptors are poor in the reproducibility of the cyan color, because the carrier transporting material of them has absorption of light in the cyan color region (400–500 nm).

SUMMARY OF THE INVENTION

The present inventors have conducted extensive researches for organic low molecular weight photoconductive compounds capable of presenting electrophotographic photoreceptors having high durability and high sensitivity over the entire wavelength range of the visible light region and as a result, have found that certain specific arylamine compounds are suitable for this purpose. The present invention has been accomplished on the basis of this discovery.

Thus, the present invention provides an electrophotographic photoreceptor comprising an electrically conductive support and a photosensitive layer formed thereon, wherein said photosensitive layer contains an arylamine compound of the formula (I):

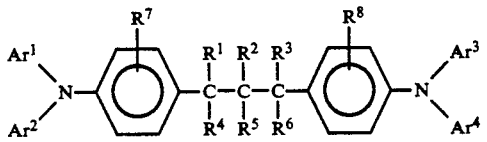

(I)

wherein each of $Ar^1$, $Ar^2$, $Ar^3$ and $Ar^4$ which may be the same or different, is an aryl group which may have substituents, or a heterocyclic group which may have substituents, each of $R^1$, $R^2$, $R^3$, $R^4$, $R^5$ and $R^6$ which may be the same or different, is a hydrogen atom, a hydroxyl group, a halogen atom, an alkyl group which may have substituents, an alkoxy group which may have substituents, or a phenyl group which may have substituents, and each of $R^7$ and $R^8$ which may be the same or different, is a hydrogen atom, a halogen atom, an alkyl group which may have substituents, or an alkoxy group which may have substituents.

Figure 1:
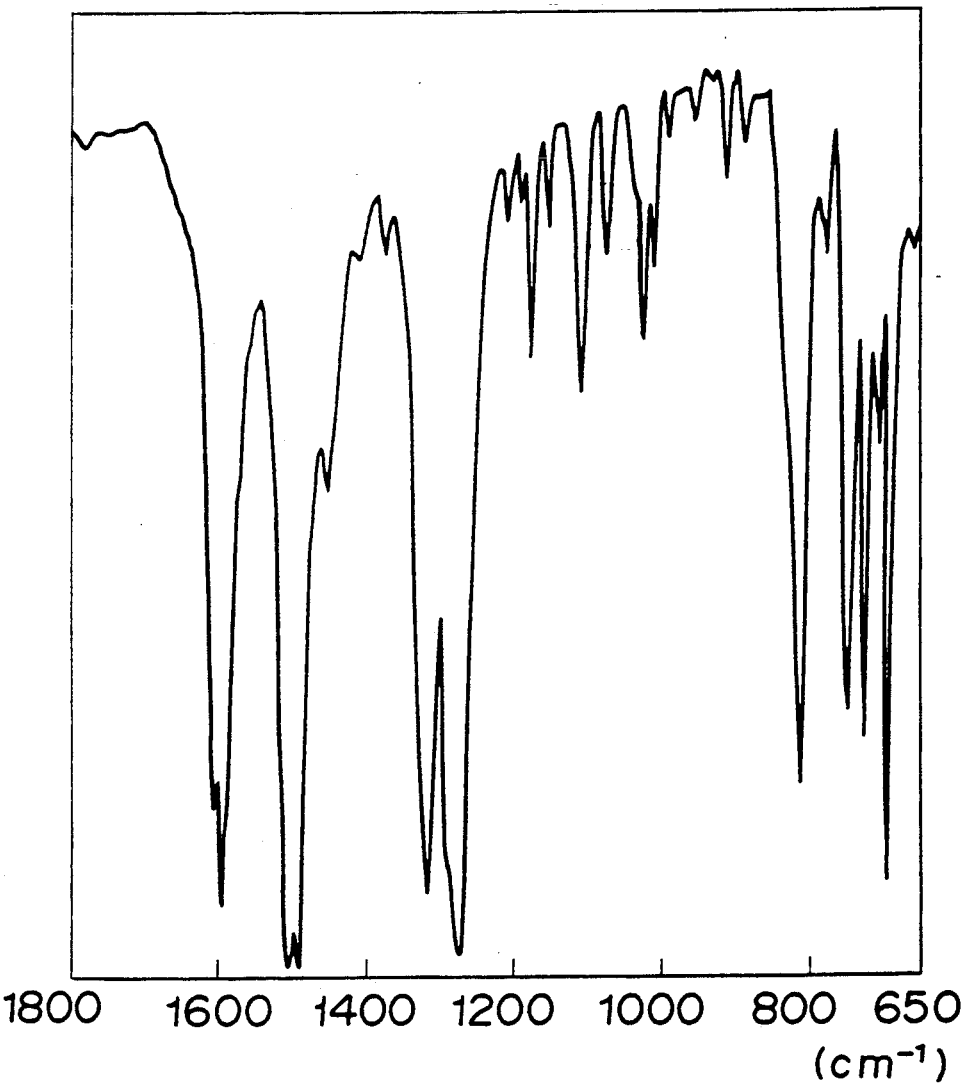
FIG. 1 is an infrared absorption spectrum of the arylamine compound obtained in Preparation Example 3.

Now, the present invention will be described in detail with reference to the preferred embodiments.

The electrophotographic photoreceptor of the present invention contains the arylamine compound of the above formula (I) in the photosensitive layer.

In the formula (I), each of $Ar^1$, $Ar^2$, $Ar^3$ and $Ar^4$ which may be the same or different, is an aryl group such as a phenyl group, a naphthyl group, an anthryl group or a pyrenyl group; or a heterocyclic group such as a pyrrolyl group, or a furyl group. An aryl group is preferred, and particularly preferred is a phenyl group.

Each of $R^1$, $R^2$, $R^3$, $R^4$, $R^5$ and $R^6$ which may be the same or different, is a hydrogen atom; a hydroxyl group; a halogen atom such as a chlorine atom, a bromine atom or an iodine atom; an alkyl group such as a methyl group, an ethyl group, a propyl group, a butyl group or a hexyl group; an alkoxy group such as a methoxy group, an ethoxy group or a butoxy group; or a phenyl group. Particularly preferred is a hydrogen atom or a methyl group.

Each of $R^7$ and $R^8$ which may be the same or different, is a hydrogen atom; a halogen atom such as a chlorine atom, a bromine atom or an iodine atom; an alkyl group such as a methyl group, an ethyl group, a propyl group, a butyl group or a hexyl group; or an alkoxy group such as a methoxy group, an ethoxy group or a butoxy group. Among them, a hydrogen atom and a methyl group are particularly preferred.

The aryl group and the heterocyclic group for $Ar^1$, $Ar^2$, $Ar^3$ and $Ar^4$, the alkyl group, the alkoxy group and the phenyl group for $R^1$, $R^2$, $R^3$, $R^4$, $R^5$ and $R^6$, and the alkyl group and the alkoxy group for $R^7$ and $R^8$, may have substituents.

The substituents include, for example, a hydroxyl group; a halogen atom such as a chlorine atom, a bromine atom or an iodine atom; an alkyl group such as a methyl group, an ethyl group, a propyl group, a butyl group or a hexyl group; an alkoxy group such as a methoxy group, an ethoxyl group or a butoxy group; an aralkyl group such as a benzyl group, a naphthylmethyl group or a phenethyl group; an aryloxy group such as a phenoxy group or tolyloxy group; an aryloxy group such as a benzyloxy group or a phenethyloxy group; an aryl group such as a phenyl group or a naphthyl group; a dialkylamino group such as a dimethylamino group or a diethylamino group; a diarylamino group such as a diphenylamino group or a dinaphthylamino group; a diaralkylamino group such as a dibenzylamino group or a diphenethylamino group; and a dihetorocyclic amino group such as a dipyridylamino group or a dithienylamino group.

The arylamine compound of the above formula (I) can be produced by a known method.

As a preferred method, a method may be mentioned wherein a starting material ketone is condensed by reaction with an aldehyde or a ketone, followed by a reductive reaction of the double bond, or by an addition reaction, and then by a reaction of the carbonyl group, to obtain the desired compound.

This method will be described in detail. Firstly, a ketone and an aldehyde or ketone represented by the following formulas (II) and (III) (in these formulas, $Ar^1$, $Ar^2$, $Ar^3$, $Ar^4$, $R^2$, $R^3$, $R^7$ and $R^8$ are as defined with respect to the formula (I), the same applies hereinafter) are reacted in a known organic solvent inert to the reaction, such as ethyl ether, benzene, methanol or ethanol, in the presence of a basic catalyst such as sodium hydroxide, sodium carbonate, sodium methoxide, sodium amide, potassium cyanide, sodium acetate, piperidine or diethylamine, or an acidic catalyst such as hydrogen chloride, zinc chloride, potassium hydrogensulfite, to obtain a compound of the formula (IV).

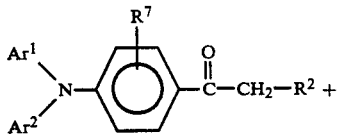

(II)

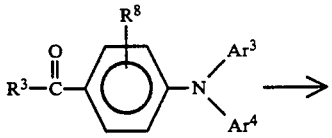

(III)

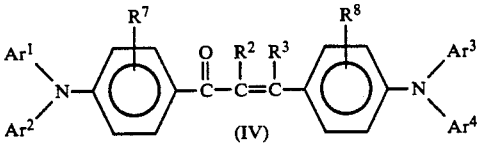

(IV)

Then, the compound of the formula (IV) is subjected to a reductive reaction of the double bond or an addition reaction, or subjected to a reaction of a ketonic moiety. In such a case, either the reaction of the double bond or the reaction of the ketonic moiety may be conducted first. Described hereinafter is a case wherein the reaction of the double bond is conducted first.

Firstly, in the reductive reaction of the double bond, the compound of the formula (IV) may be reacted with hydrogen gas in the presence of a catalyst such as palladium black, colloide palladium, colloide rhodium or Raney nickel (neutralized) in a known organic solvent inert to the reaction, such as methanol, ethanol, cyclohexane, dioxane, tetrahydrofuran, ethyl acetate or N,N-dimethylformamide, or reacted with a reagent prepared from lithium aluminum hydride and copper (I) iodide, in tetrahydrofuran, to obtain a compound of the formula (V) (here $R^5=R^6=H$).

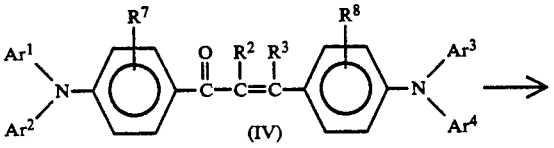

(IV)

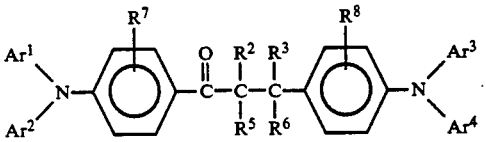

(V)

Now, in the addition reaction, the compound of the formula (IV) may be reacted with a Grignard reagent or an organic metal reagent in a known organic solvent inert to the reaction, such as diethyl ether or tetrahydrofuran, or with a hydrogen halide or a halogen such as chlorine, bromine or iodine, to obtain a compound of the formula (V).

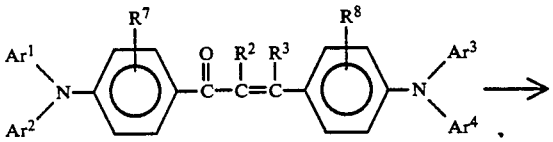

(IV)

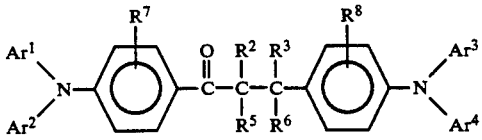

(V)

Now, the reaction of the ketonic moiety may be divided into two i.e. a reductive reaction and a nucleophilic reaction to the ketonic moiety.

The reductive reaction may further be divided into two i.e. a reaction to convert the ketonic to a secondary alcohol, and a reaction to convert the ketone directly to a methylene group.

Firstly, in the reaction to convert the ketone to a secondary alcohol, the compound of the formula (V) is treated by a reducing agent such as lithium aluminum hydride or sodium borohydride in a known organic solvent inert to the reaction, such as tetrahydrofuran or dioxane, to obtain a compound of the formula (I).

Now, in the reaction to convert the ketone directly to a methylene group, the compound of the formula (V) may be reacted with Raney nickel as a catalyst in an aqueous ethanol solution, or reacted with sodium borohydride and a borontrifluoride/ethyl ether complex, in tetrahydrofuran, or reacted with trifluoroacetic acid and sodium borohydride, in methylene chloride, to obtain a compound of the formula (I).

Now, in the nucleophilic reaction to the ketonic moiety, the compound of the formula (V) is reacted with a Grignard reagent or an organic metal reagent in a known organic solvent inert to the reaction , such as diethyl ether or tetrahydrofuran, to obtain a compound of the formula (I).

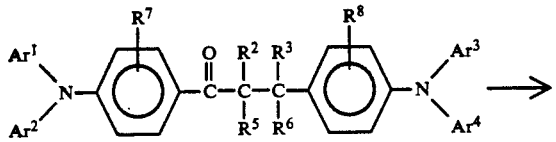

(V)

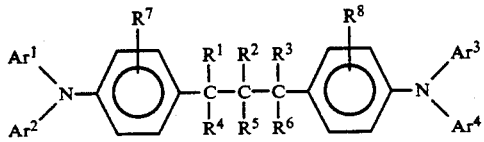

(I)

In these reactions, after completion of each step or after completion of the entire process, a known purification method such as recrystallization, sublimation or column chromatography may be applied, as the requires, to obtain a highly pure product.

The electrophotographic photoreceptor of the present invention has a photosensitive layer containing one or more of the arylamine compounds of the formula (I).

The arylamine compound of the formula (I) exhibits excellent properties as an organic photoconductive material. Especially when used as a carrier transport material, it gives a photoreceptor having high sensitivity and excellent durability.

Various types are known for the photosensitive layer for an electrophotographic photoreceptor. The photosensitive layer of the electrophotographic photoreceptor of the present invention may be any one of such types. For example, the following types may be mentioned:

(i) a photosensitive layer having the arylamine compound and a carrier generation material (photoconductive particles capable of generating an electric charge carrier at an extremely high efficiency upon absorption of light, a pigment useful as a sensitizing agent) added in a binder.

(ii) a photosensitive layer having the arylamine compound and a compound capable of forming a charge transfer complex together with the arylamine compound, added in a binder.

(iii) a photosensitive layer having laminated a carrier transport layer composed of the arylamine compound and a binder and a carrier generation layer composed of photoconductive particles (carrier generation material) capable of generating an electric charge carrier at a extremely high efficiency upon absorption of light, or composed of such photoconductive particles and a binder.

In such a photosensitive layer, a known hydrazone compound or stilbene compound having excellent properties as a carrier transport material, may be incorporated together with the arylamine compound of the formula (I).

In the present invention, when the arylamine compound of the formula (I) is used in a carrier transport layer of a photosensitive layer which comprises two layers of the carrier transport layer and a carrier generation layer, it is possible obtain a photoreceptor having particularly high sensitivity and low residual potential and which has excellent durability such that even when used repeatedly, the change in the surface potential, the deterioration of the sensitivity or the accumulation of the residual potential is small.

The electrophotographic photoreceptor of the present invention can be prepared in accordance with a usual method by dissolving the arylamine compound of the formula (I) together with the binder in a suitable solvent, adding photoconductive particles capable of generating an electric charge carrier at an extremely high efficiency upon absorption of light, a sensitizing dye, an electron attracting compound, a plasticizer, a pigment or other additives, as the case requires, to obtain a coating solution, and then applying such a coating solution on an electrically conductive support, followed by drying to form a photosensitive layer having a thickness of from a few μm to a few tens μm. The photosensitive layer comprising two layers of the carrier generation layer and the carrier transport layer can be prepared either by applying the above mentioned coating solution of the carrier generation layer, or forming a carrier generation layer on the carrier transport layer obtained by coating the above mentioned coating solution.

The solvent useful for the preparation of the coating solution is a solvent capable of dissolving the arylamine, for example, an ether such as tetrahydrofuran or 1,4-dioxane; a ketone such as methyl ethyl ketone or cyclohexanone; an aromatic hydrocarbon such as toluene or xylene; an aprotic polar solvent such as N,N-dimethylformamide, acetonitrile, N-methyl pyrrolidone; an ester such as ethyl acetate, methyl formate or methyl cellosolve acetate; or a chlorinated hydrocarbon such as dichloroethane or chloroform. It is of course necessary to select among them the one capable of dissolving the binder. The binder may be a polymer or copolymer of a vinyl compound such as styrene, vinyl acetate, vinyl chloride, an acrylate, a methacrylate or butadiene, or various polymers compatible with a styrene compound, such as polyvinyl acetal, polycarbonate, polyester, polysulfone, polyphenyleneoxide, polyurethane, cellulose ester, cellulose ether, a phenoxy resin, a silicone resin and an epoxy resin. The binder is used usually in an amount within a range of from 0.5 to 30 times by weight, preferably from 0.7 to 10 times by weight, relative to the arylamine compound.

The photoconductive particles, dyes, pigments or electron attracting compounds to be added to the photosensitive layer may be those well known in the art. The photoconductive particles capable of generating charge carriers at an extremely high efficiency upon absorption of light, include inorganic photoconductive particles such as selenium-tellurium alloy, selenium-arsenic alloy and a cadmium sulfide and amorphous silicon; and organic photoconductive particles such as metal-containing phthalocyanine, perynone dyes, thioindigo dyes, quinacridone, perylene dyes, anthraquinone dyes, azo dyes, bisazo dyes, trisazo dyes, tetrakisazo dyes and cyanine dyes. The dyes include, for example, triphenylmethane dyes such as Methyl Violet, Brilliant Green and Crystal Violet; thiazine dyes such as Methylene Blue; quinone dyes such as Quinizalin and cyanine dyes as well as pyrilium salts, thiapyrilium salts and benzopyrilium salts. The electron attracting compound capable of forming a carrier transport complex together with the arylamine compound, includes quinones such as chloranil, 2,3-dichloro-1,4-naphthoquinone, 1-nitroanthraquinone, 1-chloro-5-nitroanthraquinone, 2-chloroanthraquinone and phenanthrenequinone; aldehydes such as 4-nitrobenzaldehyde; ketones such as 9-benzoylanthracene, indanedione, 3,5-dinitrobenzophenone, 2,4,7-trinitrofluorenone, 2,4,5,7-tetranitrofluorenone and 3,3',5,5'-tetranitrobenzophenone; acid anhydrides such as phthalic anhydride and 4-chloronaphthalic anhydride; cyano compounds such as tetracyanoethylene, terephthalal malononitrile, 9-anthrylmethylidene malononitrile, 4-nitrobenzal malononitrile and 4-(p-nitrobenzoyloxy) benzal malononitrile; and phthalides such as 3-benzalphthalide, 3-(α-cyano-p-nitrobenzal)phthalide and 3-(α-cyano-p-nitrobenzal)-4,5,6,7-tetrachlorophthalide.

Further, the photosensitive layer of the electorphographic photoreceptor according to this invention may contain a well-known plasticizer for the improvement of the film-forming properties, flexibility and mechanical strength. The plasticizer to be added to the above coating solution for this purpose may be a phthalic ester, a phosphoric ester, an epoxy compound, a chlorinated paraffin, a chlorinated fatty acid ester or an aromatic compound such as methylnaphthalene. In a case where the arylamine compound is used as a carrier transport material in the carrier transport layer, the coating solution may be of the above described composition, but photoconductive particles, dyes, pigments, electron attracting compounds and the like may be eliminated or added in a small amount. The carrier generation layer in this case includes a layer prepared by forming the above mentioned photoconductive particles into a film by means of e.g. vapor position, and a thin layer prepared by applying a coating solution which is obtained by dissolving or dispersing the photoconductive particles and optionally a binder polymer as well as an organic photoconductive material, a dye and an electron attracting compound in a solvent, and drying it.

The photoreceptor thus formed may further have an adhesive layer, an intermediate layer, a transparent insulation layer or the like, as the case requires. As the electrically conductive support on which the photosensitive layer is formed, any material which is commonly used for electrophotographic photoreceptors, can be employed. Specifically, a drum or sheet of a metal such as aluminum, stainless steel or copper, or a laminate of foils of such metals, or a vapor-deposition product of such metals, may be mentioned. Further, a plastic film, a plastic drum, paper or a paper tube electrified by coating a conductive material such as metal powder, carbon black, copper iodide or a polymer electrolyte together with an appropriate binder, may be mentioned. Further, an electrically conductive plastic sheet or dram containing a conductive substance such as metal powder, carbon black or carbon fiber, may be mentioned.

The electrophotographic photoreceptor of the present invention has a very high sensitivity and a small residual potential which is likely to cause fogging, and it has a feature of excellent durability since the accumulation of the residual potential due to repeated use and fluctuations in the surface potential and in the sensitivity are minimum as the light-fatigue is minimum.

DESCRIPTION OF PREFERRED EMBODIMENTS

Now, the present invention will be described in further detail with reference to Examples. However, it should be understood that the present invention is by no means restricted by such specific Examples. In the Examples, "parts" means "parts by weight".

PREPARATION EXAMPLE 1

2 g of 4-methyltriphenylamine-4'-aldehyde of the formula:

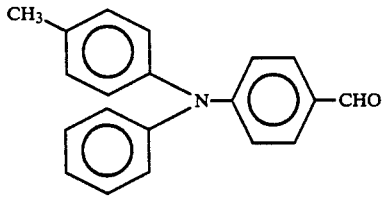

and 1.9 g of 4-methyl-4'-acethyltriphenylamine of the formula:

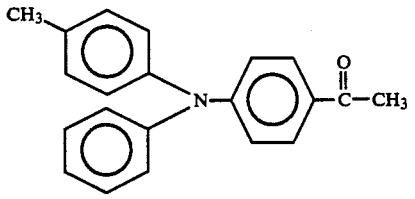

were dissolved in a solvent mixture comprising 70 ml of ethanol of and 12 ml of tetrahydrofuran. To this solution, 5.3 ml of a 10% sodium hydroxide aqueous solution was added under stirring and cooling with ice. Then, after stirring at 60° C. for 3 hours, the reaction solution was concentrated and subjected to purification treatment to obtain 3.2 g of α,β-unsaturated ketone.

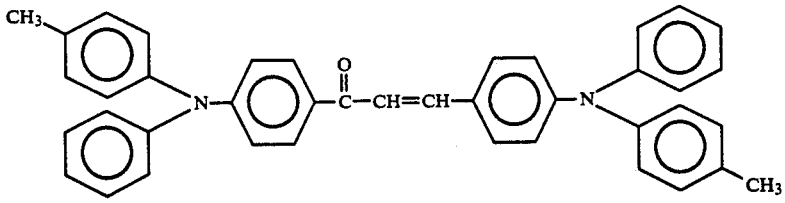

PREPARATION EXAMPLE 2

3.2 g of the $\alpha,\beta$-unsaturated ketone prepared in the Preparation Example 1 was dissolved in 10 m; of dry tetrahydrofuran. This solution was added under stirring and cooling with ice to a solution prepared by dissolving 4.3 g of copper(I) iodide and 0.2 g of lithium aluminum hydride in 70 ml of dry tetrahydrofuran, followed by stirring at the same temperature for 30 minutes. Then, 1 ml of water was added to the reaction solution, and the mixture was dried over anhydrous magnesium sulfate, then concentrated and subjected to purification to obtain 1.9 g of an orange colored oily substance.

This compound was found to be a carbonyl compound having the following structural formula, by the following values of elemental analysis, by the mass spectrometric analysis and the infrared absorption spectrum.

| Elemental analysis as $C_{41}H_{36}N_2O_1$ | | | |
|---|---|---|---|
| | C % | H % | N % |
| Calculated | 85.98 | 6.34 | 4.89 |
| Found | 85.73 | 6.57 | 4.99 |

Mass spectrometric analysis
as $C_{41}H_{36}N_2O_1$ MW = 572
$M^+$ = 572

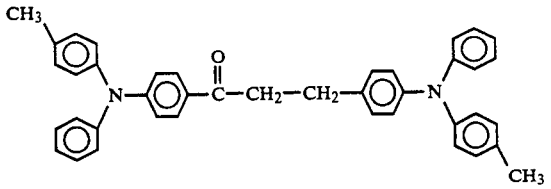

PREPARATION EXAMPLE 3

1.9 g of the carbonyl compound prepared in Preparation Example 2 was dissolved in 67 ml of dry tetrahydrofuran, and 0.3 g of sodium borohydride and 1.2 ml of a boron trifluoride/ethyl ether complex were sequentially added thereto at room temperature under a nitrogen stream. Then, the mixture was reacted at the same temperature for 20 hours. Then, 30 ml of water was added to the reaction system under cooling with ice, and extraction and purification were conducted by usual methods to obtain 1.3 g of a colorless oily substance.

This compound was found to be an arylamine compound of the following formula by the following values of elemental analysis, the mass spectrometric analysis and the infrared absorption spectrum (FIG. 1).

| Elemental analytical values as $C_{41}H_{38}N_2$ | | | |
|---|---|---|---|
| | C % | H % | N % |
| Calculated | 88.13 | 6.86 | 5.01 |
| Found | 88.23 | 7.01 | 4.76 |

Results of the mass spectrometric analysis
as $C_{41}H_{38}N_2$ MW = 558
$M^+$ = 558

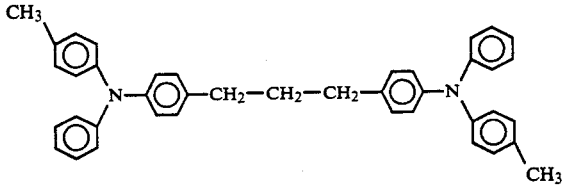

EXAMPLE 1

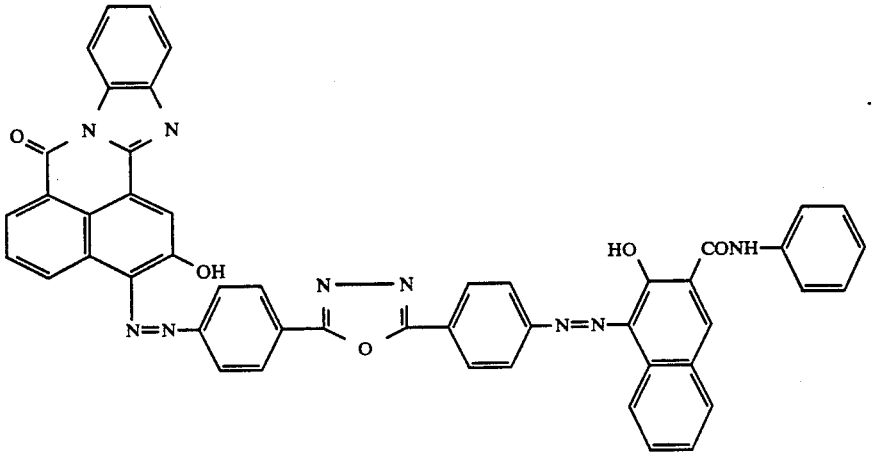

1.4 parts of a bisazo dye having the above formula, 0.7 part of a polyvinyl butylal resin (#6000/C, manufactured by Denki Kagaku Kogyo K.K.) and 0.7 part of a phenoxy resin (PKHH, registered trademark, manufactured by Union Carbide Company) were dispersed and pulverized in 44 parts of methyl ethyl ketone and 15 parts of 4-methoxy-4-methylpentanone-2 by a sand-grinder.

This dispersion was coated by a wire bar on an aluminum layer vapor-deposited on a polyester film having a thickness of 75 μm so that the weight after drying would be 0.7 g/m$^2$, followed by drying to form a carrier generation layer.

A coating solution prepared by dissolving 80 parts of the arylamine compound prepared in Preparation Example 3 and 100 parts of a polycarbonate (Upirone E2000, registered trademark, manufactured by Mitsubishi Gas Kagaku K.K.) in 900 parts of dioxane, was coated thereon and dried to form a carrier transport layer having a thickness of 20 μm.

With respect to the electrophotographic photoreceptor having a photosensitive layer comprising two layers thus obtained, the sensitivity i.e. the half-decay exposure intensity was measured and found to be 0.60 lux·sec.

Here, the half-decay exposure intensity was determined by firstly charging the photoreceptor in a dark place with corona discharge at −5.2 KV, then subjecting it to exposure to incandescent light, and measuring the exposure intensity required until the surface potential decayed to one-half of the initial surface potential.

Besides, it is found that this photoreceptor is excellent in the spectral sensitivity over the entire wavelength region of visible light.

EXAMPLE 2

A photoreceptor was produced in the same manner as Example 1 except that a bisazo dye of the following formula was used instead of the bisazo dye used in Example 1, and the sensitivity was measured in the same manner as in Example 1 and found to be 1.10 lux·sec.

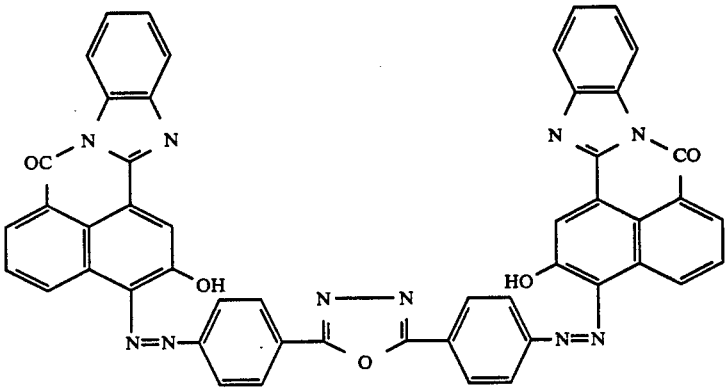

EXAMPLES 3 to 16

Electrophotographic photoreceptors were produced in the same manner as in Example 1 except that arylamine compounds as identified in Table 1 prepared in the same manner as in Preparation Example 3 were used instead of the arylamine compound used in Example 1 and the bisazo dye used in Example 1 was used for the carrier generation layer, and their sensitivities are shown in the following Table.

TABLE 1
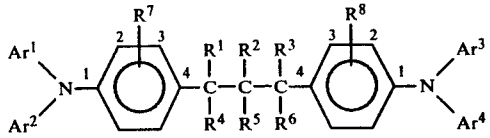
| Example No. | Substituents $Ar^1$ | $Ar^2$ | $Ar^3$ | $Ar^4$ | $R^1$ | $R^2$ | $R^3$ | $R^4$ | $R^5$ | $R^6$ | $R^7$ | $R^8$ | Sensitively (lux · sec) |
|---|---|---|---|---|---|---|---|---|---|---|---|---|---|
| 3 | 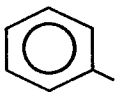 | 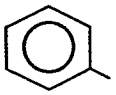 | 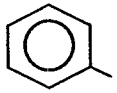 | 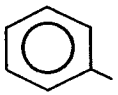 | H | H | H | H | H | H | H | H | 0.7 |
| 4 | $CH_3O$ 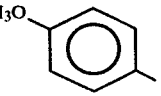 | 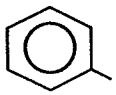 | $CH_3O$ 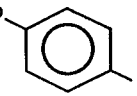 | 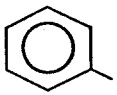 | H | H | H | H | H | H | H | H | 0.7 |
| 5 | $CH_3$ 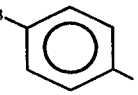 | 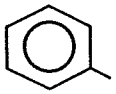 | $CH_3$ 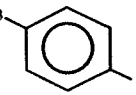 | 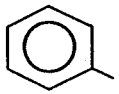 | $CH_3$ | H | H | H | H | H | H | H | 1.0 |
| 6 | 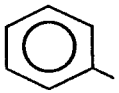 | 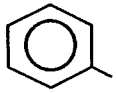 | 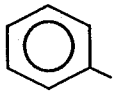 | 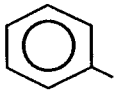 | H | 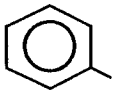 | H | H | H | H | H | H | 0.6 |
| 7 | 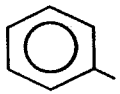 | 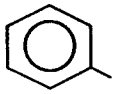 | 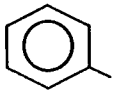 | 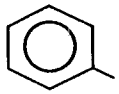 | $CH_3$ | $CH_3$ | H | H | H | H | H | H | 1.0 |
| 8 | $CH_3$ 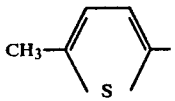 S | 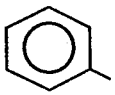 | $CH_3$ 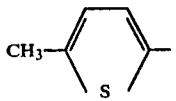 S | 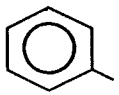 | H | Br | Br | H | H | H | H | H | 3.5 |
| 9 | $CH_3$ 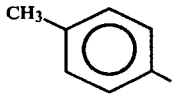 | $CH_3$ 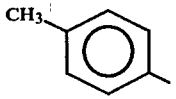 | $CH_3$ 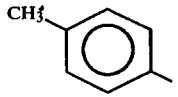 | $CH_3$ 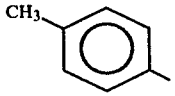 | H | H | $CH_3$ | $CH_3$ | H | H | H | H | 1.3 |

TABLE 1-continued
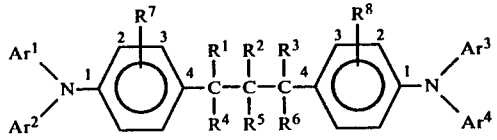
| Example No. | Substituents $Ar^1$ | $Ar^2$ | $Ar^3$ | $Ar^4$ | $R^1$ | $R^2$ | $R^3$ | $R^4$ | $R^5$ | $R^6$ | $R^7$ | $R^8$ | Sensitively (lux · sec) |
|---|---|---|---|---|---|---|---|---|---|---|---|---|---|
| 10 | 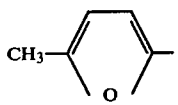 | 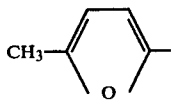 | 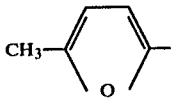 | 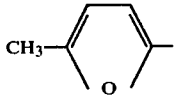 | H | H | $CH_3$ | $OCH_3$ | H | H | H | H | 2.4 |
| 11 | 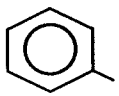 | 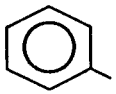 | 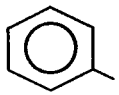 | 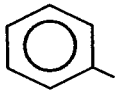 | H | H | H | OH | Br | Br | H | H | 5.3 |
| 12 | 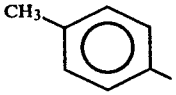 | 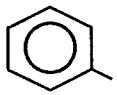 | 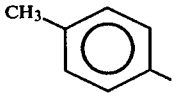 | 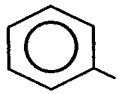 | H | H | H | $OCH_3$ | H | $CH_3$ | 2-$CH_3$ | 2-$CH_3$ | 2.0 |
| 13 | 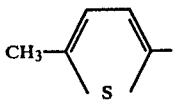 | 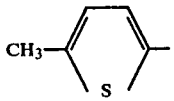 | 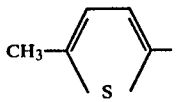 | 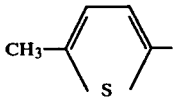 | H | H | H | H | H | $CH_3$ | 2-Cl | 2-Cl | 3.2 |
| 14 | 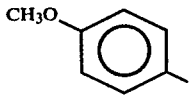 | 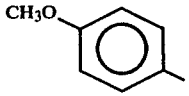 | 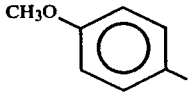 | 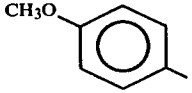 | H | H | H | H | H | H | 3-$OCH_3$ | 3-$OCH_3$ | 1.9 |
| 15 | 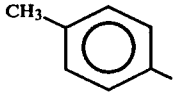 | 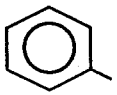 | 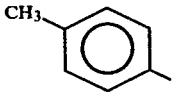 | 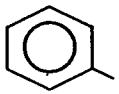 | $CH_3$ | $CH_3$ | $CH_3$ | OH | H | H | 2-$CH_3$ | 2-$CH_3$ | 4.5 |
| 16 | 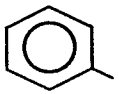 | 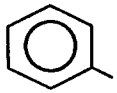 | 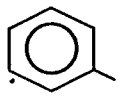 | 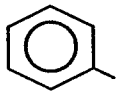 | $CH_3$ | H | H | $OCH_3$ | Br | Br | 2-Cl | 2-Cl | 2.4 |

Comparative Examples 1 to 3

Electrophotographic photoreceptors were prepared in the same manner as in Example 1 except that arylamine compounds as identified in Table 2 were used instead of the arylamine compound used in Example 1. Each electrophotographic photoreceptor was charged in a dark place with corona discharge at −5.2% KV, whereby the surface potential was measured as the initial surface potential. Then, after measuring the sensitivity in the same manner as in Example 1, it was subjected to adequate exposure (50 lux·sec), whereby the surface potential as the residual potential was obtained. The results are shown in Table 2 together with the results of the measurement with respect to the electrophotographic photoreceptor of Example 3.

In Comparative Examples 1 and 2, the arylamine compounds were hardly soluble in a solvent, and it was practically impossible to conduct the measurements.

TABLE 2

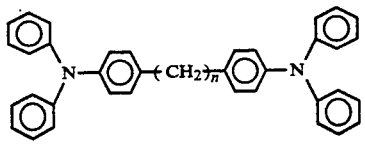

| | n | Initial surface potential (V) | Sensitivity (lux · sec) | Residual potential (V) |
|---|---|---|---|---|
| Comparative Example 1 | 1 | — | — | — |
| Comparative Example 2 | 2 | −968 | — | — |
| Comparative Example 3 | 5 | −560 | 2.2 | −37 |
| Example 3 | 3 | −702 | 0.7 | −1 |

The compounds wherein n is 1 or 2 can not practically be used. It is evident that a compound wherein n is 5 shows numerical values inferior in both the sensitivity and the residual potential as compared with the compounds of the present invention.

We claim:

1. An electrophotographic photoreceptor comprising an electrically conductive support and a photosensitive layer formed thereon, wherein said photosensitive layer contains an arylamine compound of the formula (I):

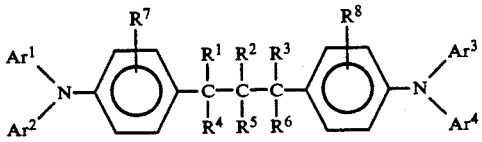

(I)

wherein each of $Ar^1$, $Ar^2$, $Ar^3$ and $Ar^4$ which may be the same or different, is an aryl group which may have substituents, or a heterocyclic group which may have substituents, each of $R^1$, $R^2$, $R^3$, $R^4$, $R^5$ and $R^6$ which may be the same or different, is a hydrogen atom, a hydroxyl group, a halogen atom, an alkyl group which may have substituents, an alkoxy group which may have substituents, or a phenyl group which may have substituents, and each of $R^7$ and $R^8$ which may be the same or different, is a hydrogen atom, a halogen atom, an alkyl group which may have substituents, or an alkoxy group which may have substituents.

2. The electrophotographic photoreceptor according to claim 1, wherein in the formula (I), each of $Ar^1$, $Ar^2$, $Ar^3$ and $Ar^4$ is an aryl group which may have substituents.

3. The electrophotographic photoreceptor according to claim 2, wherein in the formula (I), each of $Ar^1$, $Ar^2$, $Ar^3$ and $Ar^4$ is a phenyl group which is unsubstituted or substituted by an alkyl group or by an alkoxy group.

4. The electrophotographic photoreceptor according to claim 2, wherein in the formula (I), one of $Ar^1$, $Ar^2$, $Ar^3$ and $Ar^4$ is a phenyl group which is substituted by an alkyl group or by an alkoxy group.

5. The electrophotographic photoreceptor according to claim 1, wherein in the formula (I), each of $R^1$, $R^2$, $R^3$, $R^4$, $R^5$ and $R^6$ is a hydrogen atom or a methyl group.

6. The electrophotographic photoreceptor according to claim 1, wherein in the formula (I), each of $R^7$ and $R^8$ is a hydrogen atom or a methyl group.

7. The electrophotographic photoreceptor according to claim 1, wherein the photosensitive layer further contains a carrier generation material and/or a compound capable of forming a charge transfer complex together with the arylamine compound of the formula (I).

8. The electrophotographic photoreceptor according to claim 7, wherein the carrier generation material is at least one member selected from the group consisting of inorganic photoconductive particles, organic photoconductive particles and sensitizing dyes.

9. The electrophotographic photoreceptor according to claim 7, wherein the photosensitive layer comprises a carrier generation layer containing the carrier generation material as the main component and a carrier transport layer containing the arylamine compound of the formula (I) and a binder resin.

10. The electrophotographic photoreceptor according to claim 1, wherein the formula (I), one of $R^1$, $R^2$, $R^3$, $R^4$, $R^5$ and $R^6$ is a methyl group.

11. The electrophotographic photoreceptor according to claim 1, wherein in the formula (I), one of $R^7$ and $R^8$ is a methyl group.

12. The electrophotographic photoreceptor according to claim 1, wherein in the formula (I), one of $Ar^1$, $Ar^2$, $Ar^3$ and $Ar^4$ is a heterocyclic group which may have substituents.

13. The electrophotographic photoreceptor according to claim 1, wherein in the formula (I), one of $Ar^1$, $Ar^2$, $Ar^3$ and $Ar^4$ is a heterocyclic group which is unsubstituted or substituted by an alkyl group or by an alkoxy group.

14. The electrophotographic photoreceptor according to claim 1, wherein in the formula (I), one of $Ar^1$, $Ar^2$, $Ar^3$ and $Ar^4$ is an aryl group selected from the group consisting of naphthyl, anthryl and pyrenyl.

15. The electrophotographic photoreceptor according to claim 1, wherein in the formula (I), one of $Ar^1$, $Ar^2$, $Ar^3$ and $Ar^4$ is a heterocyclic group selected from the group consisting of pyrrolyl, and furyl.

* * * * *